US010037843B2

(12) United States Patent
Bertels

(10) Patent No.: US 10,037,843 B2
(45) Date of Patent: Jul. 31, 2018

(54) ELECTRICAL DEVICE, IN PARTICULAR A COIL OR A TRANSFORMER

(71) Applicant: Compact Electro-Magnetic Technology and Eco-Logical Enterprises B.V., Nijkerk (NL)

(72) Inventor: Augustinus Wilhelmus Maria Bertels, Doorwerth (NL)

(73) Assignees: Compact Electro-Magnetic Technology, Nijkerk (NL); Eco-Logical Enterprises B.V., Nijkerk (NL)

( * ) Notice: Subject to any disclaimer, the term of this patent is extended or adjusted under 35 U.S.C. 154(b) by 0 days.

(21) Appl. No.: 15/329,473

(22) PCT Filed: Jul. 28, 2015

(86) PCT No.: PCT/NL2015/050551
§ 371 (c)(1),
(2) Date: Jan. 26, 2017

(87) PCT Pub. No.: WO2016/018149
PCT Pub. Date: Feb. 4, 2016

(65) Prior Publication Data

US 2017/0213635 A1 Jul. 27, 2017

(30) Foreign Application Priority Data

Jul. 30, 2014 (NL) ..... 2013277

(51) Int. Cl.
*H01F 27/29* (2006.01)
*H01F 27/28* (2006.01)
(Continued)

(52) U.S. Cl.
CPC ..... *H01F 27/2804* (2013.01); *H01F 27/22* (2013.01); *H01F 27/24* (2013.01);
(Continued)

(58) Field of Classification Search
CPC ..... H01F 27/00–27/36
(Continued)

(56) References Cited

U.S. PATENT DOCUMENTS 316,354 A 4/1885 Gaulard
728,038 A 5/1903 Stowe
(Continued)

FOREIGN PATENT DOCUMENTS

AT 390 600 5/1990
EP 0 035 964 9/1981
(Continued)

OTHER PUBLICATIONS

International Search Report from PCT/NL2014/050459 dated Jul. 8, 2014.
(Continued)

*Primary Examiner* — Tuyen Nguyen
(74) *Attorney, Agent, or Firm* — Swanson & Bratschun, L.L.C.

(57) ABSTRACT

The invention relates to an electrical device comprising a stack of electrical elements, wherein: a central axis is defined in the stack; each element comprises an electrically insulating carrier; the carrier carries an electrically conductive loop-shaped track; both end zones of the track are located in the edge zone of the carrier; the loop-shaped tracks each form a turn and are arranged around the central axis in the stack; the end zones are connected to each other in electrically conductive manner such that the turns form one winding in at least groupwise manner; the carriers are congruent and each have a form such that they can be rotated from a starting position through an angle a around the central axis to a rotated position in which they take up the same space as in the starting position; adjacent elements with tracks which together form a winding are disposed rotated
(Continued)

through an angle a relative to each other, and the mutually registered end zones are mutually connected by an electrical conductor extending transversely of the elements; the free end zones of the tracks of the outermost elements of the stack of elements form the externally accessible terminals of the or each winding; the elements are connected non-releasably to each other, and the stack has a peripheral surface with a form which is prismatic at least in its central zone, i.e. has the same cross-sectional form at any axial position.

20 Claims, 13 Drawing Sheets

(51) Int. Cl.
*H01F 27/22* (2006.01)
*H01F 27/24* (2006.01)
*H01F 41/04* (2006.01)

(52) U.S. Cl.
CPC ..... *H01F 27/29* (2013.01); *H01F 41/041* (2013.01); *H01F 2027/2809* (2013.01)

(58) Field of Classification Search
USPC ... 336/65, 83, 180–184, 196, 200, 206–208, 336/220–223, 232
See application file for complete search history.

(56) References Cited

U.S. PATENT DOCUMENTS

| | | | | |
|---|---|---|---|---|
| 2,911,605 | A * | 11/1959 | Wales, Jr. ..... | H01F 17/0006 29/604 |
| 3,089,106 | A * | 5/1963 | Saaty ..... | H01F 27/2804 29/602.1 |
| 4,517,540 | A | 5/1985 | McDougal | |
| 5,038,104 | A * | 8/1991 | Wikswo, Jr. ..... | G01R 33/0358 324/248 |
| 2006/0278963 | A1 | 12/2006 | Harada | |
| 2011/0074397 | A1 | 3/2011 | Bulumulla | |
| 2012/0068693 | A1 | 3/2012 | Ocket | |
| 2012/0094555 | A1 | 4/2012 | Calverley | |
| 2012/0299685 | A1 | 11/2012 | Yokota | |
| 2016/0163445 | A1 | 6/2016 | Bertels | |

FOREIGN PATENT DOCUMENTS

| | | |
|---|---|---|
| EP | 0 435 461 | 7/1991 |
| EP | 0 601 791 | 6/1994 |
| EP | 0 953 993 | 11/1999 |
| EP | 1 260 998 | 11/2002 |
| EP | 1 353 436 | 10/2003 |
| JP | H06 325948 | 11/1994 |

OTHER PUBLICATIONS

International Search Report from PCT/NL2015/050551 dated Jan. 1, 2016.

* cited by examiner

ELECTRICAL DEVICE, IN PARTICULAR A COIL OR A TRANSFORMER

RELATED APPLICATIONS

This application is a 35 U.S.C. § 371 national phase application of PCT/NL2015/050551 (WO 2016/018149), filed on Jul. 28, 2015, entitled "Electrical Device, in Particular a Coil or a Transformer", which application claims priority to Netherlands Application No. 2013277, filed Jul. 30, 2014, which is incorporated herein by reference in its entirety.

The invention relates to an electrical device, in particular a coil or a transformer.

Such a device is generally known in different embodiments. A coil comprises one electrically conductive winding, in particular of insulated copper wire, the ends of which arc externally accessible for the purpose of transmitting electric current, in particular alternating current. Such a coil can be a coreless coil or an air coil but can also comprise a ferromagnetic core, optionally with an external yoke forming a closed magnetic circuit with the core. The self-inductance of the coil is hereby increased substantially.

Such a device can also be embodied as transformer. A transformer comprises a minimum of two windings, in particular a primary winding and one or more secondary windings. It is for instance possible to envisage a transformer for transforming down from the mains voltage of for instance 115 V or 230 V AC, which is transformed down by the transformer to a voltage of for instance several volts. For this purpose the transformer comprises a primary winding with a relatively large number of turns and one or more secondary windings with a smaller number of turns. It is usual for such a transformer to comprise a ferromagnetic core with an external yoke.

The drawback of such a known device is that it is heavy, expensive due to the nature of the production technique and takes up much space.

It is an object of the invention to embody a device of the described type such that the device is suitable for mass production, can be manufactured at relatively low cost and can be given a very light form.

With a view to the above the invention provides an electrical device, in particular a coil or a transformer, comprising a stack of electrical elements, wherein:

in the stack a central axis is defined which extends perpendicularly of the electrical elements;

each element comprises an electrically insulating flat carrier;

the carrier carries at least one electrically conductive loop-shaped track;

both end zones of the or each track are located in the edge zone of the carrier;

the loop-shaped tracks each form a turn and are arranged around the central axis in the stack;

the end zones are connected to each other in electrically conductive manner such that the turns form one winding in at least groupwise manner and that the electric currents conducted through the turns during operation of the device generate summating magnetic fields in the zone enclosed by the turns;

the carriers are congruent and each have a form such that they can be rotated from a starting position through an angle $\alpha$ around the central axis to a rotated position in which they take up the same space as in the starting position;

adjacent elements with tracks which together form a winding are disposed rotated through an angle relative to each other such that only one end zone of the track of the one element is in register position relative to only one end zone of the track of the adjacent element, and these mutually registered end zones arc mutually connected by an electrical conductor extending transversely of the elements;

the free end zones of the tracks of the outermost elements of the stack of elements, or at least that part of the stack with tracks which together form one winding, form the externally accessible terminals of the or each winding;

the elements are connected non-releasably to each other, and the stack has a peripheral surface with a form which is prismatic at least in its central zone, i.e. has the same cross-sectional form at any axial position.

According to an important aspect of the invention, the device has the special feature that each track is located some distance from the peripheral edge of the carrier;

the end zones of the track are located close to the peripheral edge of the carrier in the edge zone thereof; and situated on the outer side of the stack and extending over the full height thereof are electrical conductors which each connect two mutually registered end zones of the tracks of adjacent elements electrically to each other.

The adjacent elements with tracks which together form a winding cover an overall angle of rotation of $n \cdot \alpha$, wherein $n \cdot \alpha$ must be less than 360°.

In respect of the foregoing the device can advantageously have the special feature that each carrier is round.

The device can alternatively be embodied such that each carrier has the form of a regular polygon. The polygon comprises a number of sides which equal $360°/\alpha$.

The device preferably has the special feature that a ferromagnetic core is located in the space of the stack enclosed by the turn. A greatly increased self-inductance is hereby achieved for a coil and achieved for a transformer is that the windings have a substantially stronger mutual electromagnetic coupling.

In a further practical embodiment the device has the special feature that a ferromagnetic zone is located in the space enclosed by the turn of each electrical element;

each flat carrier comprises a plastic substrate; and the ferromagnetic zone comprises a magnetic material in powder form which is mixed through the substrate material and is thus embedded therein in substantially homogenous distribution.

Such an embodiment can particularly be mass-produced in very simple manner on large industrial scale with a limited number of production steps.

A device of the latter type preferably has the feature that the end zones of the core are coupled at least magnetically to each other by a ferromagnetic yoke extending outside the stack such that the core and the yoke together form a closed magnetic circuit. Stray fields are hereby prevented and the effectiveness of the operation of the ferromagnetic core is substantially enhanced.

A further improvement is achieved with an embodiment in which the yoke comprises two yoke parts extending on either side of the stack.

A preferred embodiment has a special feature that the yoke comprises two ferromagnetic plates at least magnetically coupled to the end zones of the core and a ferromagnetic jacket at least magnetically coupled to these plates; and situated in the jacket and/or in at least one of the plates is a passage for allowing through electrical conductors connected to both terminals of the or each winding.

In an important variant the device has the special feature that the ferromagnetic yoke comprises a plastic substrate into which magnetic material in powder form is mixed and is thus embedded therein in substantially homogenous distribution; and the yoke is manufactured by injection moulding.

According to yet another aspect of the invention, the device has the feature that respective electrically conductive pins are connected to both terminals of the or each winding, which pins extend outside the peripheral surface of the device.

According to an important aspect of the invention, the device can have the special feature that the pins are located in a zone forming part of a flat part of the peripheral surface of the device extending in longitudinal direction, and the pins extend perpendicularly of this flat part.

A device designed as transformer, for instance power supply transformer, can have the feature that the tracks of the elements of the stack together form at least two windings, wherein a primary winding is configured to receive a relatively high alternating voltage and the or each other secondary winding is configured to generate a relatively low alternating voltage; and the pins connected to the primary windings are located at the one axial end zone of the device, and the pins connected to the or each secondary winding are located at the other axial end zone of the device.

According to an important aspect, the above specified device according to the invention serving as transformer has the special feature that the pins are located in a zone forming part of a flat part of the peripheral surface of the device extending in axial direction, and the pins extend perpendicularly of this flat part. Such a transformer can be easily arranged on a printed circuit board or other carrier, the carrier being provided beforehand with for instance through-holes or other connecting provisions for correct positioning and electrical connection of the transformer and the electric connecting pins.

According to a further practical aspect of the invention, the device can have the special feature that the tracks of the or each secondary winding have a larger cross-section than the tracks of the primary winding. In such an embodiment the generation of heat per volume unit in the tracks of the primary winding or in the or each secondary winding can be substantially the same during operation, whereby temperature differences can be reduced to negligible proportions.

It is known that for instance power supply transformers for electronic units which convert the available mains voltage to a lower voltage must generally have a large mass because of the relatively low mains frequency, in particular 50 or 60 Hz. With a view to a still further miniaturization according to the invention an embodiment is recommended in which a frequency converter is added to the device embodied as transformer which converts the frequency of the alternating current to be supplied to the primary winding from a relatively low value, for instance 50 or 60 Hz, to a relatively high value of a minimum of 100 kHz.

The device still more preferably has the special feature that the relatively high value of the frequency amounts to a minimum of 1 MHZ.

According to an important aspect of the invention, the device can have the special feature that thermally conductive protrusions are situated on the outer side of the device, for instance pins, wires or fins, which at least partially relinquish heat generated in the device to the surrounding area.

Such protrusions can be embodied in per se known manner in a suitable thermally conductive material, for instance a metal such as copper, aluminium, silver.

As practical alternative the device can be embodied such that the protrusions consist together or in groups of a plastic substrate through which thermally conductive material in powder form, for instance aluminium powder, copper powder, silver powder, carbon powder, diamond powder, is mixed and thus embedded therein in substantially homogenous distribution; and the protrusions are manufactured together or in groups by injection moulding or extrusion.

According to yet another aspect of the invention, the device has the special feature that each flat carrier consists of film material with a thickness of a maximum of about 100 μm.

It is particularly possible to envisage film thicknesses of 50 μm or less, and even to the order of 10 μm.

A practical choice in the context of the invention is that where the film material is PI (polyimide) or PEI (polyetherimide).

Polyimide and polyetherimide are materials with an extremely good temperature loadability. Melting of the materials and degeneration due to heating occur only at extremely high temperatures, i.e. above 400° C.

The device according to the invention is highly suitable for miniaturization. It is thus possible to envisage an embodiment in which the maximum linear dimension of the device, for instance the diameter of a cylindrical device, transversely of the central axis amounts to 10 mm, preferably 8 mm, still more preferably 6 mm.

The invention will now be elucidated with reference to the accompanying drawings. In the drawings.

Figure 1:
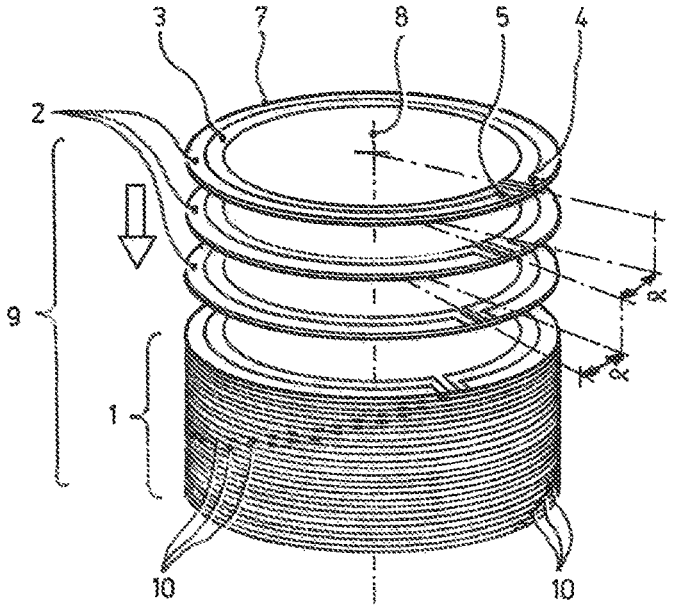
FIG. 1 is a perspective, partially exploded view of a stack of electrical elements in the preliminary phase of the manufacture of a coil based thereon.
Figure 15:
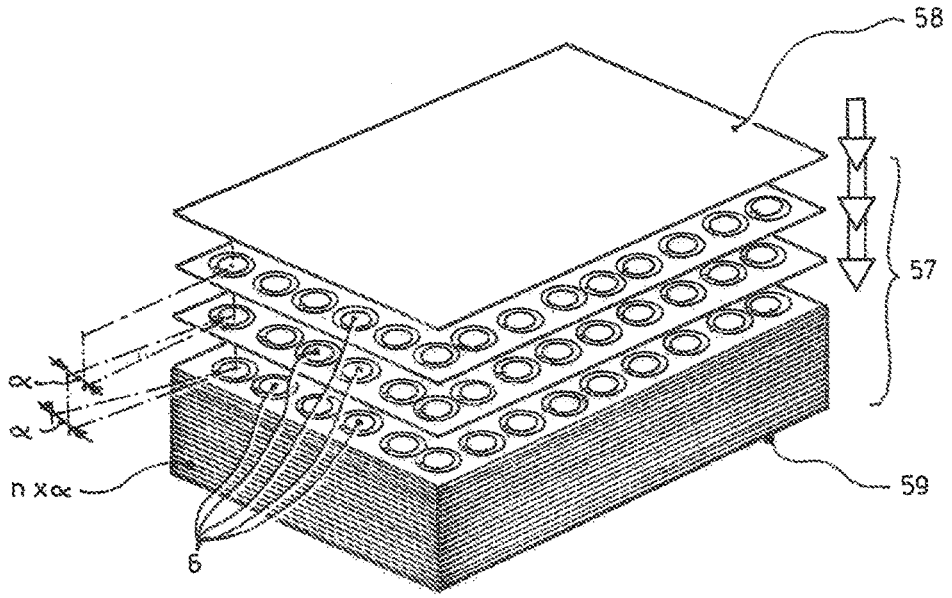
Figure 16:
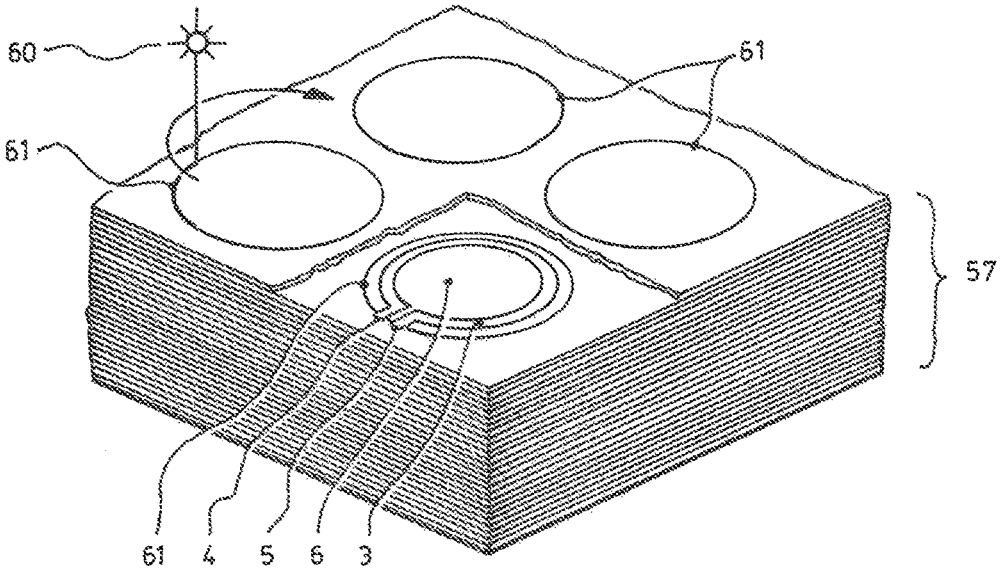
Figure 17:
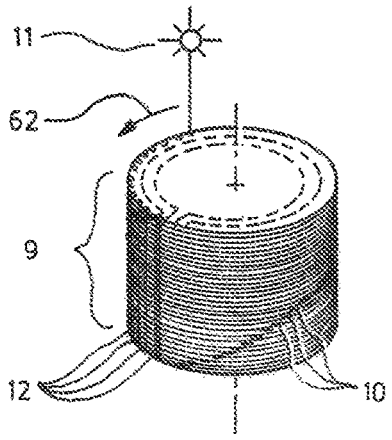
Figure 18:
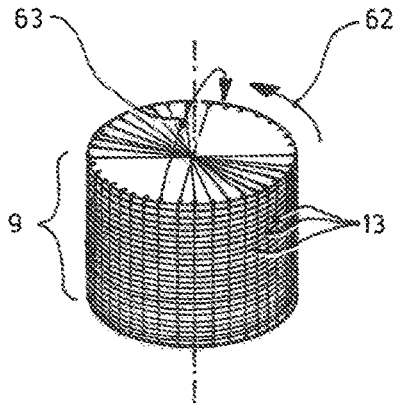
Figure 19:
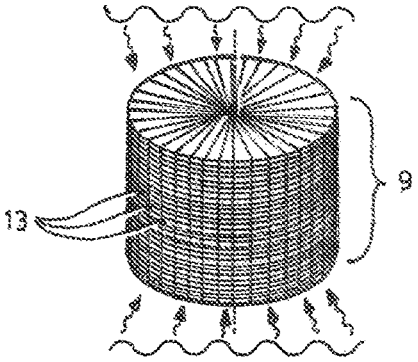
Figure 20:
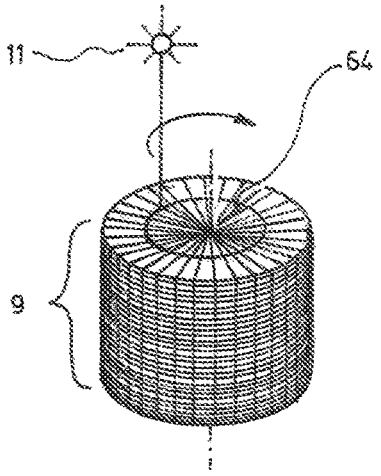
Figure 21:
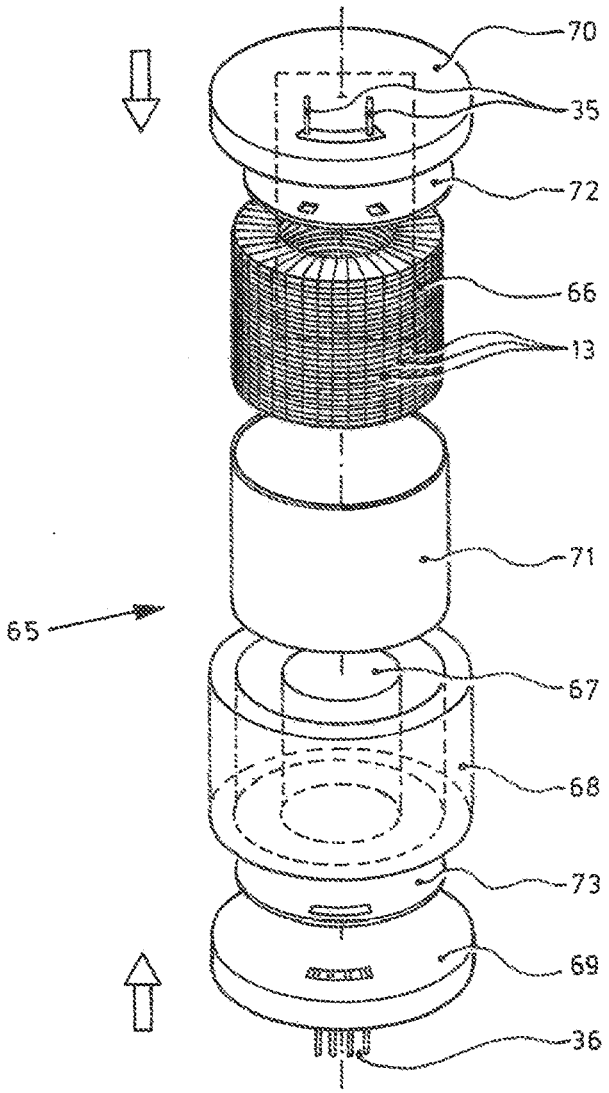
Figure 22:
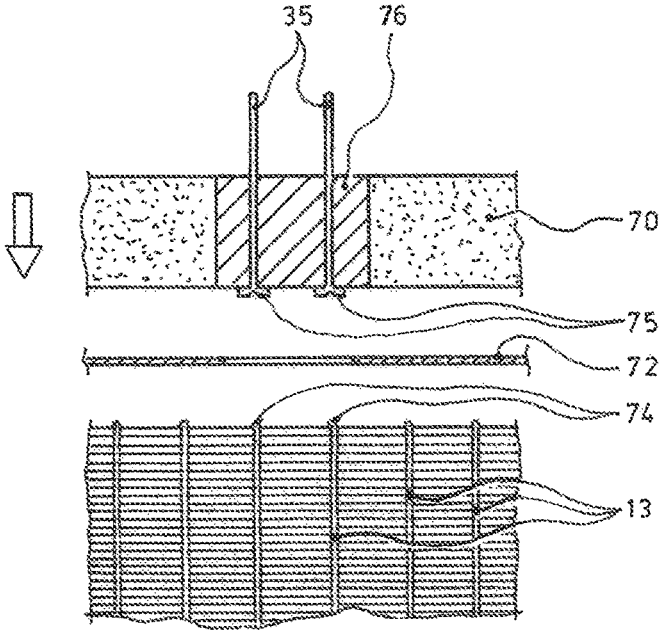
Figure 23:
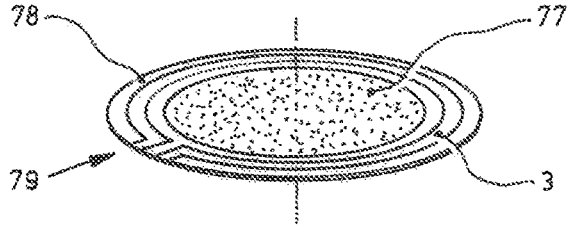
Figure 24:
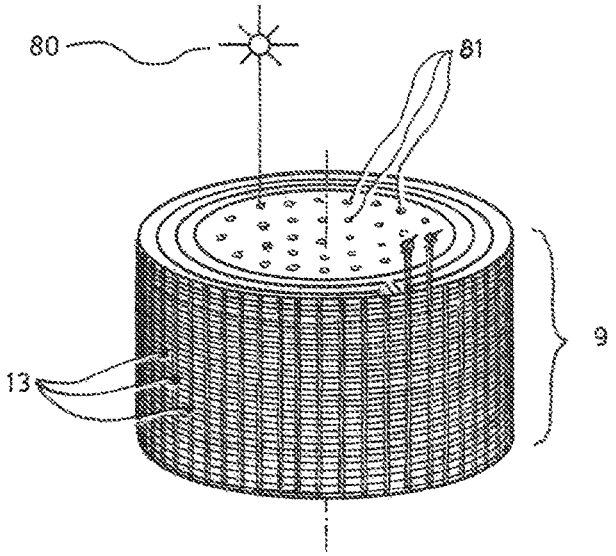

FIG. 15 is a perspective, partially exploded view corresponding to FIG. 1 of a stack of multiple, not yet mutually connected and cured carriers with loop-shaped copper tracks, wherein the end zones of the copper tracks of adjacent carriers are rotated in each case through an angle α, the angle α corresponding to the angular distance between the end zones of the copper tracks, such that only one end zone of each copper track is placed in register with only one end zone of an adjacent copper track;

FIG. 16 is a schematic view of the manner in which a number of stacks of electrical elements arc cut out of the stack according to FIG. 15 by means of a laser;

FIG. 17 is a schematic perspective view of a subsequent process wherein longitudinal angularly equidistant (α) grooves are arranged by means of a laser in the peripheral surface of the cylinder in the areas of the end zones of the copper tracks;

FIG. 18 is a view corresponding to FIG. 17 of the subsequent phase in which, by stepwise rotation through in each case the angle α and diagonal winding, copper wires with a solder sheath are placed in the grooves obtained according to FIG. 17 over the whole effective surface of the stack;

FIG. 19 shows a stack of electrical elements provided with a complete set of connecting wires, which stack is heated in a schematically designated oven or magnetron device such that the carrier-film material cures and the end zones, which are provided with a layer of soldering material, are connected at the position of the longitudinal grooves in electrically conductive manner by soldering to the wires provided with a layer of soldering material;

FIG. 20 is a schematic view of the finished and cured stack according to FIG. 19, wherein a coaxial cylindrical through-hole is arranged by means of a laser for the purpose of arranging a ferromagnetic core and removing the central zones around the central axis of the connecting wires;

FIG. 21 is an exploded view of a complete transformer with ferromagnetic core and yoke and external connecting pins on the basis of the stack of electrical elements according to FIG. 20;

FIG. 22 shows a vertical section on enlarged scale of the connection between the end zones of a winding and the associated external electrical connecting pins, in combination with closing of the ferromagnetic yoke;

FIG. 23 shows a round, flat, membrane-like plastic carrier with a substantially circular loop-shaped copper track and a ferromagnetic zone which is present in the central zone thereof and in which ferromagnetic powder material is incorporated in fine distribution in the plastic substrate of the flat carrier in order to form a continuous ferromagnetic core inside the space, enclosed by the turns of a winding, of a stack of electrical elements; and FIG. 24 is a perspective view of a stack of electrical elements prior to curing of the plastic at the stage where a number of longitudinal through-holes are arranged in the plastic substrate material by means of a schematically designated laser for the purpose of accelerating evaporation of solvent from the starting plastic material.

FIG. 1 shows a perspective view of a partial stack 1 of electrical elements 2 to be described below.

Figure 7:
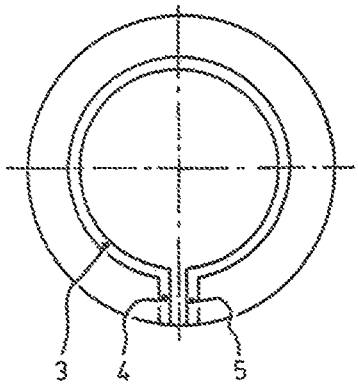
FIG. 7 is a top view corresponding to FIGS. 4, 5 and 6 of a carrier with a circular form.

As shown particularly clearly in the top view of FIG. 7, each electrical element 2, which in this embodiment has a circular form, comprises a film-like plastic carrier, in particular of PI or PEI, on which a loop-shaped electrically conductive track 3 of copper is present. The end zones of track 3, which are designated 4, 5, extend as far as the peripheral edge of plastic carrier 6. At the position of this peripheral edge 7 the end zones 4, 5 have a mutual angular distance relative to central axis 8 (see FIG. 1) of a value α. Particular reference is made in this respect to FIG. 1.

The adjacent elements 2 of the complete stack 9 are placed such that each end zone 4, 5 of an element is registered with only one end zone of the adjacent element 2. The registered zones of the complete stack, which are all designated with the reference numeral 10, thus acquire the linear helical form shown clearly in, among others, FIG. 1. Once stack 9 has been thus formed and the electrical elements are connected non-releasably to each other in the manner to be described below, the registered zones must he connected to each other for electrical conduction. For this purpose end zones 4, 5 are provided beforehand with soldering material, for instance an eutectic mixture of lead and tin. According to FIG. 1, end zone 4 of each upper-lying element is connected to each end zone 5 of each element lying thereunder. The mutually offset relation is thus obtained with the drawn helical form as result.

Realized with the described coupling in each case of an end zone 4 to the subsequent end zone 5 is that the windings of a coil and of a winding of a transformer are respectively connected in series to each other.

FIG. 17 shows the manner in which the longitudinal grooves are arranged in the peripheral surface of stack 9 using laser 11. The angular distance between these grooves amounts to α, as will be apparent from the foregoing description.

Positioned in grooves 12 in a manner to be described below with reference to FIGS. 18, 19, 20 are copper wires which are provided with a cover layer of soldering material, in particular an eutectic mixture of lead and tin.

Figure 2:
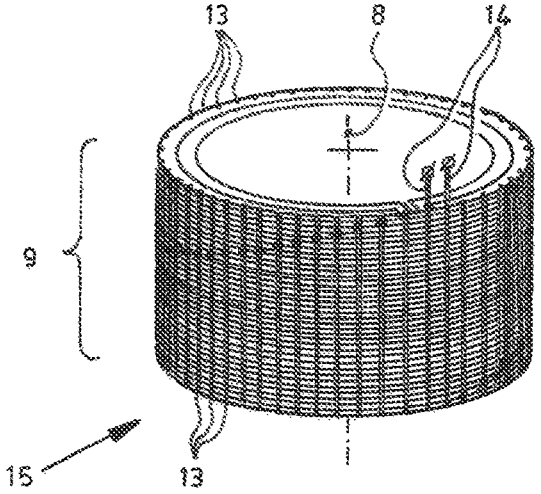
FIG. 2 shows the finished stack according to FIG. 1 in which the end terminals of the coil have been formed and protrude outward.

FIG. 2 shows the situation in which wires 13 are positioned in the grooves. In this or at least a technically equivalent situation heating of stack 9 takes place with the thus placed wires 13. Curing of the plastic material of carriers 6 hereby takes place, while due to the presence of the wires the registered zones are also individually connected to each other by realizing a sufficiently high temperature, i.e. a temperature above the melting temperature of the soldering material, without the danger of any form of further undesired contact between such zones.

As shown in FIG. 2, two wires designated 14 protrude on the upper side above stack 9. These are terminals of the complete coil. It will be apparent herefrom that, in accordance with the present concept, the described helical form of the registered zones 10 can extend through an angle of less than 360°.

The coil according to FIG. 2 manufactured in the above described manner is designated with reference numeral 15.

Coil 15 is of the type which does not have a ferromagnetic core. Only the plastic of carriers 6 is located in the space present defined by the tracks 3 operating as turns.

Figure 3:
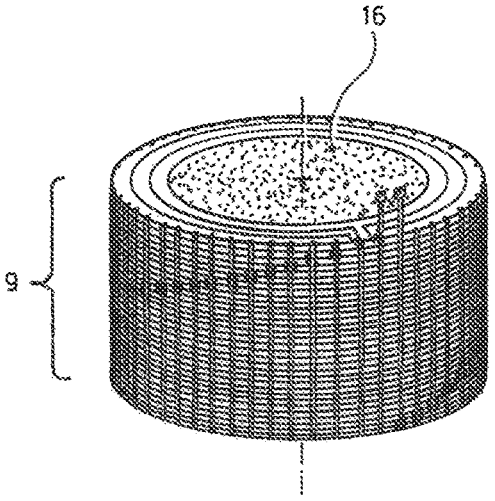
FIG. 3 is a perspective view corresponding to FIG. 2 of a coil in which a ferromagnetic core is present in the space enclosed by the copper tracks.

FIG. 3 shows a variant in which a ferromagnetic core 16 is located in the space enclosed by tracks 3. This can in principle be arranged in two ways. A first manner of arrangement consists of a cylindrical part of the plastic material being removed, for instance by making use of a laser, and a pre-manufactured core, for instance of ferrite material, being placed into the thus created cylindrical space.

As alternative the carriers 6 can be embodied in their central zone, i.e. in the zone within the conductive tracks 3, such that ferromagnetic material in powder form is embedded in the plastic of the usually film-like carriers 3. By assembling and curing stack 9 under high temperature and optionally pressure a non-releasable unit is thus formed which is provided with a ferromagnetic core.

Figure 4:
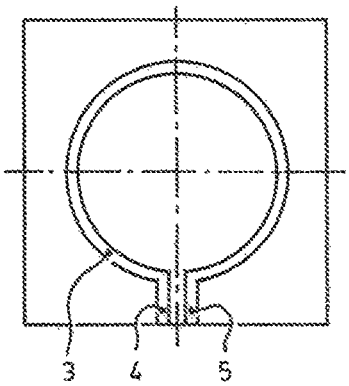
FIG. 4 is a top view of a square film-like flat carrier with a copper track.

FIG. 4 shows by way of example another form of a carrier, i.e. a square shape. Such a shape could be used as element for a stack in which end zones 4 are all connected to each other and end zones 5 are all connected to each other. The turns, consisting of tracks 3, of such a coil are not in series in such an embodiment but connected in parallel. Such a coil can also be manufactured by means of the process drawn in and described with reference to the foregoing figures.

Figure 5:
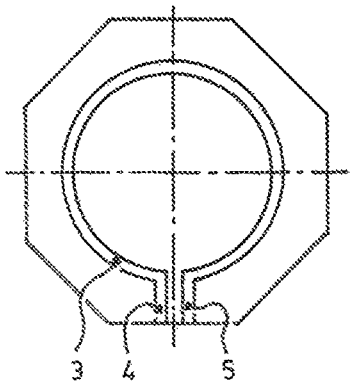
FIG. 5 is a view corresponding to FIG. 4 of a flat film-like carrier having the form of a regular octagon.

FIG. 5 shows a variant with a flat film-like plastic carrier in the form of a regular octagon.

Figure 6:
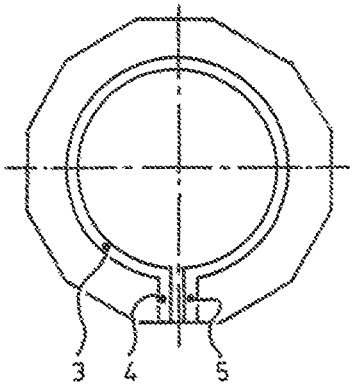
FIG. 6 is a top view corresponding to FIGS. 4 and 5 of an embodiment in which the carrier has the form of a regular dodecagon.

FIG. 6 shows an embodiment in which the film-like plastic carrier, for instance of PE or PEI, takes the form of a regular dodecagon.

FIG. 7 shows the carrier 2 already described in the foregoing which has a circular form.

Figure 8:
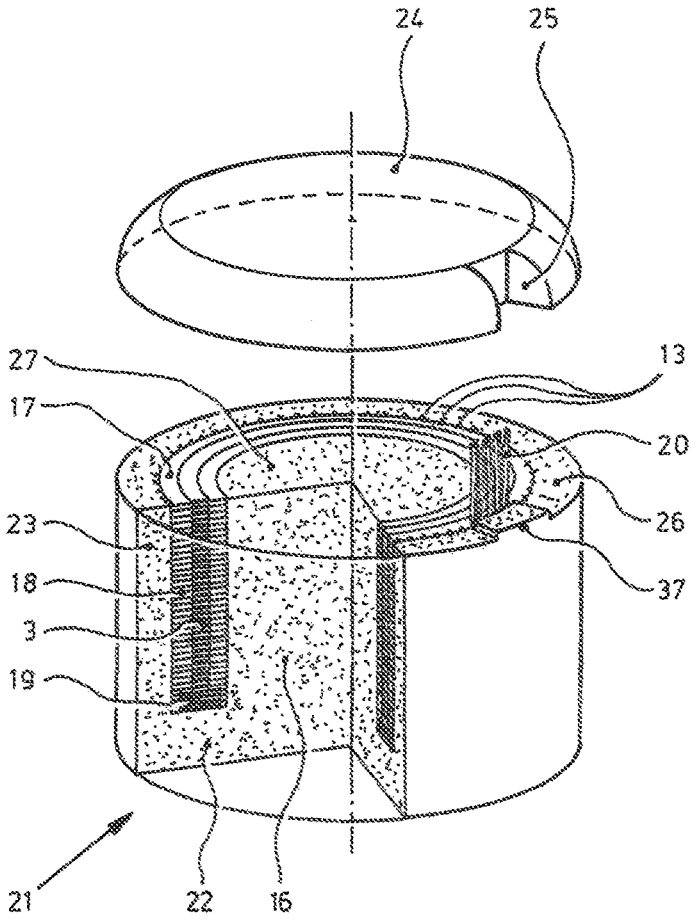
FIG. 8 is a cut-away, partially exploded perspective view of a transformer with a ferromagnetic core and a ferromagnetic yoke.

FIG. 8 is a cut-away perspective view, with removed upper yoke part or cover, of a transformer with a ferromagnetic core and a ferromagnetic yoke. The manner in which a transformer with an internal cylindrical through-cavity can be manufactured will be apparent on the basis of the above description. This transformer is designated in stricter sense with reference numeral 17. It comprises a stack of carriers, the upper part 18 of which forms the primary winding and the lower part 19 forms the secondary winding. The end terminals of the primary winding and those of the secondary winding are carried to the outside and are designated with reference numeral 20.

The electromagnetic coupling between the primary winding and secondary winding is substantially improved in this embodiment in that a core and a yoke co-acting therewith are added to the transformer. Ferromagnetic core 16 is formed as monolithic unit with a ferromagnetic bottom plate 22 and a ferromagnetic jacket 23. The thus resulting magnetic circuit is closed on the upper side after placing of a ferromagnetic cover 24 which has an edge recess 25 through which the terminals of the primary winding and those of the secondary winding extend. Edge recess 25 co-acts for positioning purposes with a correspondingly formed elevation 37 which protrudes from end surface 26.

The coupling between end surface 26 of the jacket and end surface 27 of the core and the lower surface of cover 24 can be realized by making use of a very thin adhesive layer.

Attention is drawn to the fact that copper tracks 3 of primary winding 18 have a smaller cross-sectional area than those of secondary winding 19. As is after all generally known from transformer technology, the cross-sectional area of a turn must be selected in the light of the current to be transmitted. For a secondary winding which generates a voltage of for instance 1 V, this is substantially greater than is the case for the primary winding, which is for instance intended for an alternating voltage of for instance 230 V.

Figure 9:
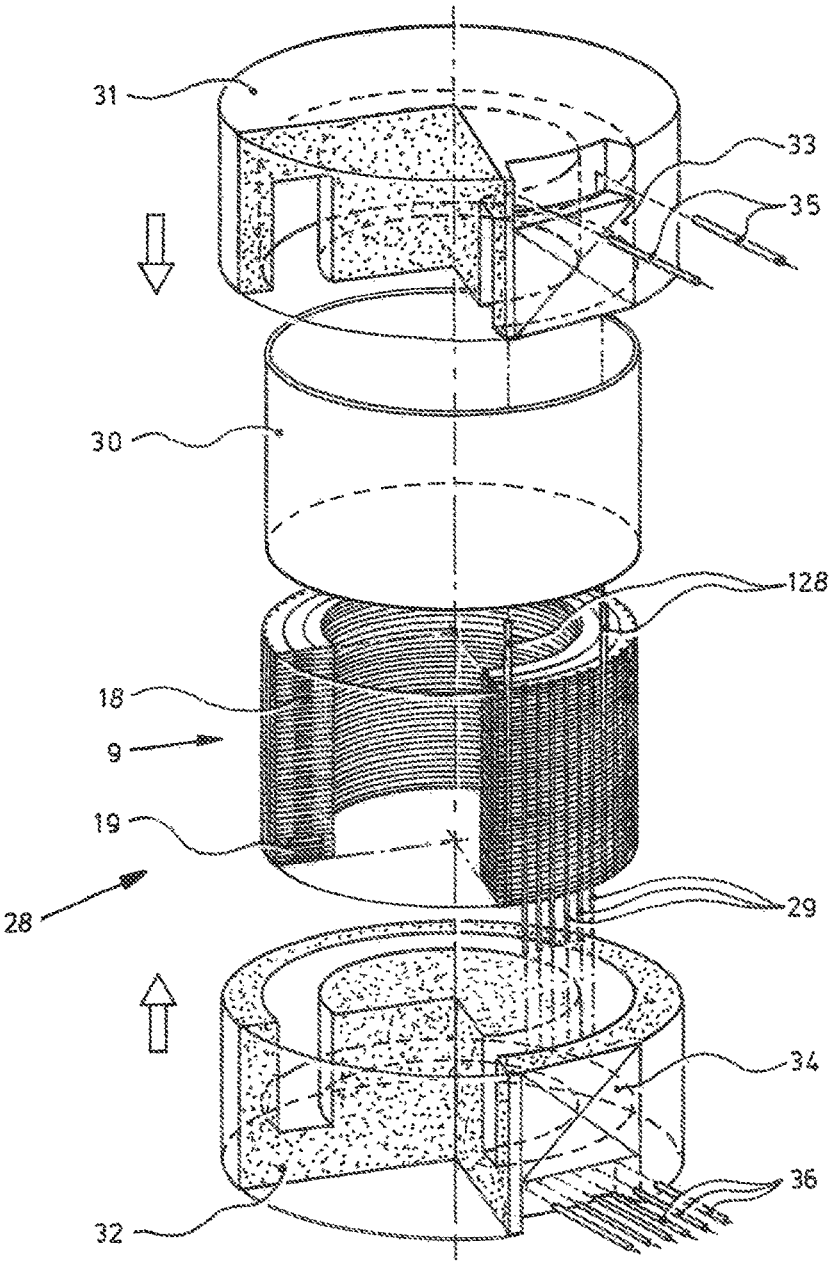
FIG. 9 is an exploded view of a variant of the transformer according to FIG. 8.

FIG. 9 is an exploded view of a variant of the transformer according to FIG. 8. Transformer 28 according to FIG. 9 comprises primary winding 18 and two secondary windings which are jointly designated with reference numeral 19.

The terminals of the primary winding are designated with reference numeral 128, while the terminals of the three secondary windings are jointly designated with reference numeral 29.

FIG. 9 shows that the two connecting wires of the primary winding, which are designated with 128, extend upward while the six wires forming the terminals of the three secondary windings extend downward.

A ferromagnetic core with yoke is constructed symmetrically and via a thin electrically insulating jacket 30 can be arranged from both sides over the ends of stack 9 and subsequently fixed with for instance a small quantity of adhesive.

It is important to note that the two ferromagnetic yoke parts 31, 32 together define on their outer side a flat surface 33, 34 perpendicularly of which the connecting pins 35 of the primary winding extend at the one axial end zone, while connecting pins 36 of the three secondary windings extend perpendicularly thereof on the other axial side. As a result of the presence of this flat surface and the fact that pins 35, 36 extend perpendicularly thereof, transformer 28 can be easily positioned on a carrier of an electronic unit, after which pins 35, 36 are fixed, for instance with a welding or soldering process, to electrically conductive tracks.

Figure 10:
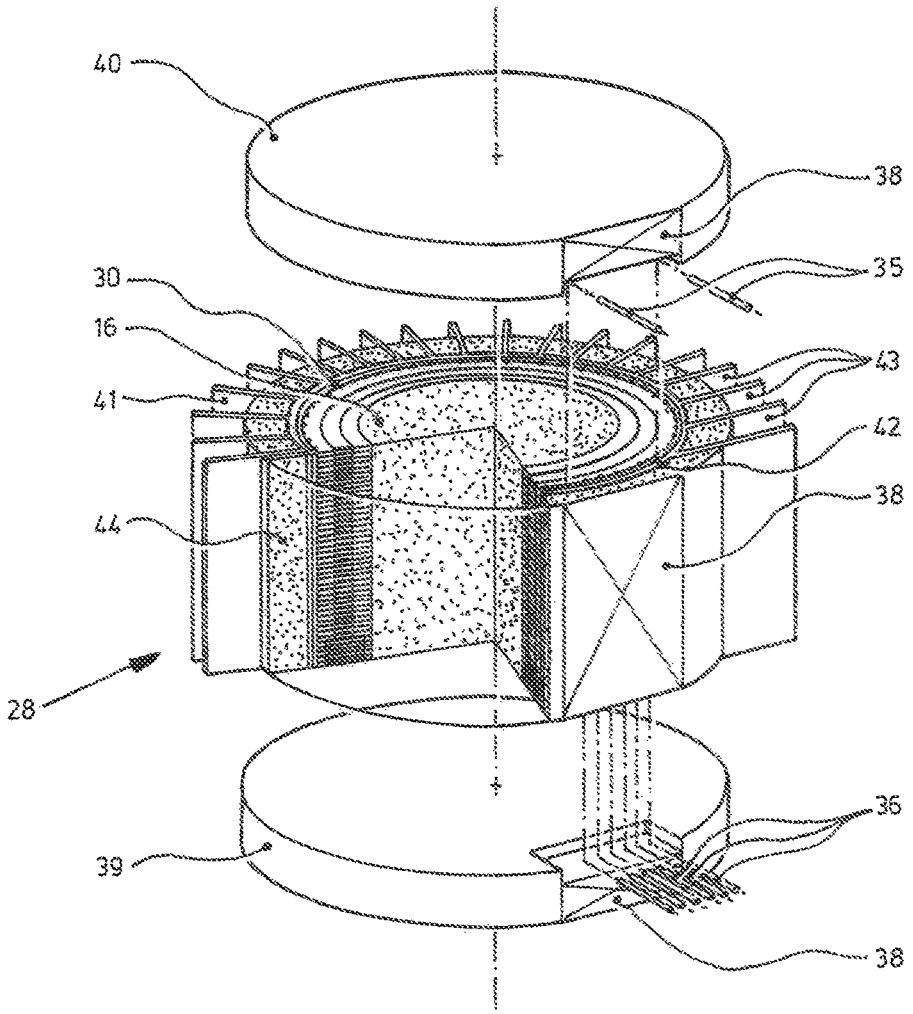
FIG. 10 is an exploded view of a variant of the transformer according to FIG. 9 which is provided with cooling fins.

FIG. 10 shows a transformer 28 which has a flat placing surface 38 and comprises a ferromagnetic core 16. The ferromagnetic core co-acts with a likewise ferromagnetic bottom plate 39 and a ferromagnetic cover 40, the end zones of which are coupled magnetically to each other by means of a more or less cylindrical element 41 comprising an aluminium cylinder 42 formed by extrusion and having cooling fins 43 extending in longitudinal direction, wherein a more or less cylindrical discrete element 44 of ferromagnetic material is situated in the space between aluminium cylinder 42 and cooling fins 43, which element 44 extends between the bottom plate and the cover and so closes the magnetic circuit. The monolithically formed aluminium cylinder 42 and cooling fins 43 can advantageously be formed together with the discrete ferromagnetic element 44 by co-extrusion. Ferromagnetic element 44 can be embodied as a for instance thermoplastic plastic which functions as substrate in which ferromagnetic material in powder form is embedded.

Figure 11:
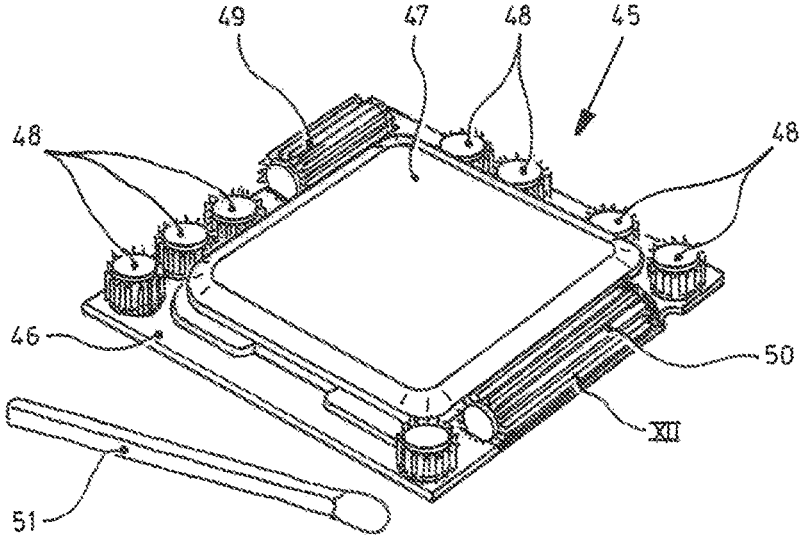
FIG. 11 shows an electronic unit with a carrier, an electronic processor present thereon and a number of micro-transformers according to the invention.

FIG. 11 shows an electronic unit 45 with a carrier, for instance of the printed circuit board type, on which is situated an electronic processor 47 which is powered with low direct voltages. Power supply transformers are also provided for this purpose on the carrier. The eight vertically disposed, substantially cylindrical transformers are all designated 48, while two elongate horizontal transformers are designated respectively 49 and 50.

For purposes of comparison a match 51 is placed next to electronic unit 45. This has the particular purpose of indicating the small dimensions of transformers 48, 49, 50.

All transformers are provided with cooling fins. Transformers 48 can he by and large of type as according to FIG. 10, with the proviso that the connecting pins are located on the lower end surface of the transformers. Transformers 49 and 50 can be of the type of transformer 28 as according to FIG. 10, albeit that transformers 49 and 50 take a more elongate form.

It will be apparent from FIG. 11 that the space still available on carrier 46 can be utilized very effectively for the placing of the transformers. This is a great advantage of the principles of the invention. The transformers can after all be manufactured very small and, due to the presence of the cooling fins in co-action with a forced airflow as is usual in computer and in particular server environments, bring about a highly effective cooling.

Figure 12:
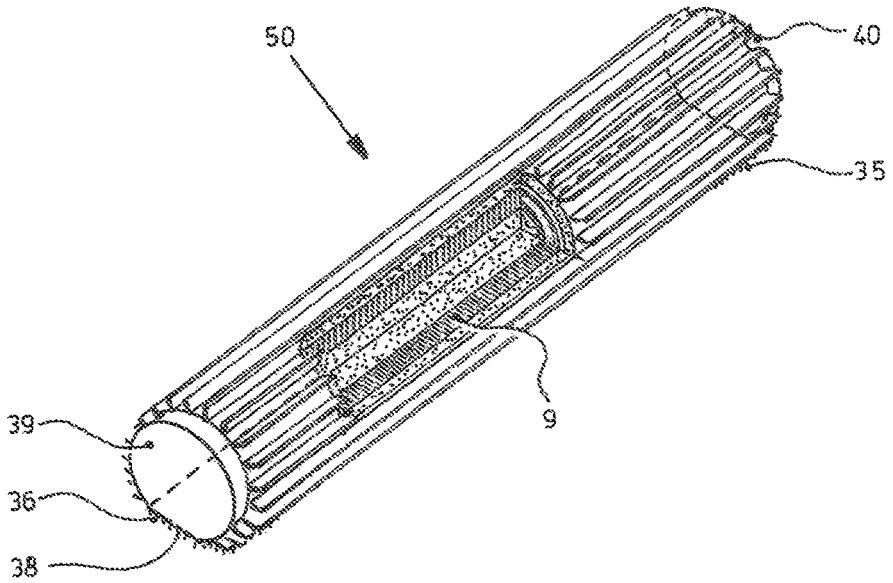
FIG. 12 is a partially cut-away perspective view on enlarged scale of the elongate transformer designated XII in FIG. 11.

FIG. 12 shows transformer 50, which for the sake of completeness is designated with the reference XII in FIG. 11, on larger scale and partially cut-away.

Situated on the underside of transformer 50 is a flat placing surface with which in the mounted situation as according to FIG. 11 the transformer is in stable contact with the upper surface of the plate-like, for instance plastic carrier 46. Pins 35, 36 protrude perpendicularly from this surface 38 and in the mounted state extend through through-holes in carrier 46. Situated on the underside thereof are conductive tracks, wherein connecting pins 35, 36 are connected for electrical conduction.

As a result of the usual application of a forced cooling airflow along an electronic unit of the type according to FIG. 11 it makes little difference in practice in which direction the thermally conductive, for instance aluminium cooling fins 43 extend. The cooling fins of transformers 49 and 50 extend in horizontal direction, while the cooling fins of transformers 48 extend vertically.

Figure 13:
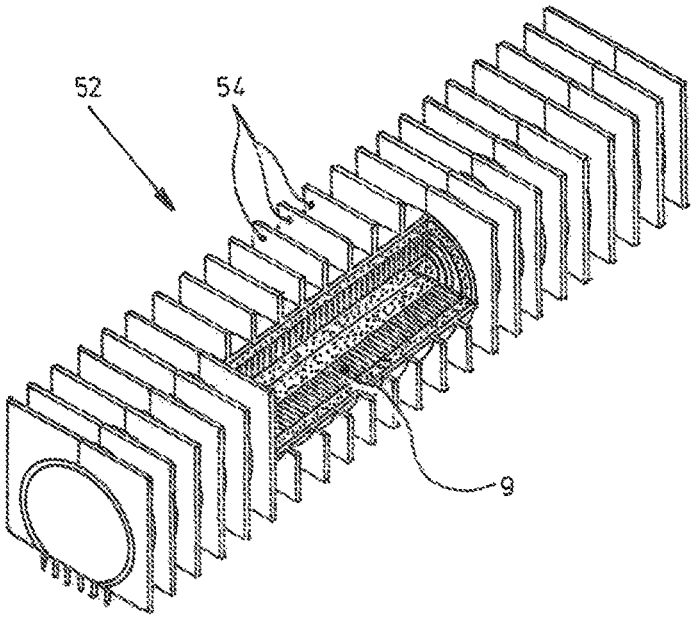
FIG. 13 is a perspective view corresponding to FIG. 12 of an alternative transformer provided with vertically disposed cooling fins.

FIG. 13 shows a variant in which an elongate transformer 52 is provided with a divided aluminium sleeve 53 which is assembled following mounting and both parts of which are provided with vertical cooling fins 54. Each sleeve part with cooling fins can be embodied as aluminium injection-moulded part.

Figure 14:
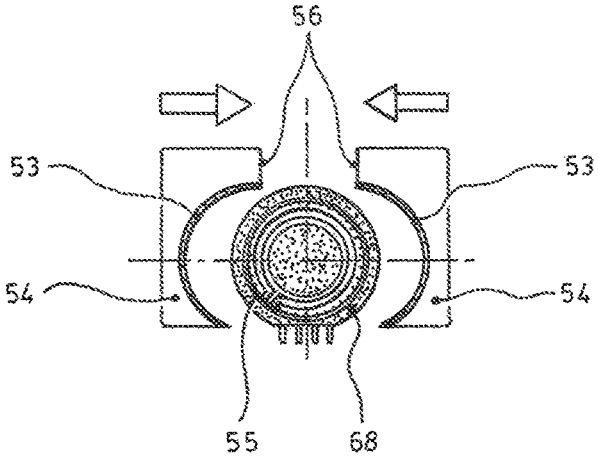
FIG. 14 shows a cross-section through the transformer according to FIG. 13 at the stage where the aluminium injection-moulded parts carrying the cooling fins are placed and fixed in close-fitting manner around the transformer.

FIG. 14 shows that the aluminium sleeve parts 53 are placed via an electrically insulating jacket 55 over stack 9. This electrically insulating jacket is for instance of a suitable plastic with a small thickness such that its heat resistance is negligible. An electrically insulating plate 58, 59 is located on the underside and on the upper side of stack 57.

FIG. 16 shows on enlarged scale the manner in which a number of stacks of electrical elements, for instance of the type according to FIG. 7, are cut out of the stack 57 according to FIG. 15 by means of a schematically designated laser 60. The cutting contours of the laser are designated with reference numeral 61. Attention is drawn to the fact that the cutting contour of the laser is circular and extends through end zones 4, 5 of copper track 3. This ensures that the end zones, which are provided with a layer of soldering material, always extend all the way to the outer surface or the peripheral surface of the associated stack as according to for instance FIG. 1.

FIG. 17 has already been discussed in the foregoing. With a stepwise rotation of stack 9 as according to arrow 62 the stack is rotated successively further through an angle a each time such that laser 11 is able to arrange the grooves 12 in the jacket zone of cylindrical stack 9.

FIG. 18 shows the subsequent phase in which, once again by successive stepwise rotation as according to arrow 62, each time through an angle $\alpha$, and by diagonal winding, the wires are positioned in the indicated desired manner After a central cylindrical hole has been arranged in stack 9 using laser 11, by heating the stack the device 9 can be completed by curing of the plastic carriers. The heating takes place to a temperature at which the soldering material melts and wires 13 are soldered fixedly at the end zones, and wherein the material of the plastic carriers cures. This temperature must be selected under all conditions so as to be substantially lower than the value at which degeneration of the plastic material could occur.

FIG. 20 is a schematic view of the finished and cured stack according to FIG. 19, wherein a coaxial cylindrical through-hole 64 is arranged by means of laser 11 for the purpose of arranging a ferromagnetic core and removing the connecting wires at the position of the two central zones around the central axis.

FIG. 21 is an exploded view of a transformer 65 with a basic transformer consisting of a unit of windings obtained following the operation with a laser 11 as according to FIG. 20, a ferromagnetic core 67, a ferromagnetic jacket 68, a ferromagnetic bottom plate 69 and a ferromagnetic cover 70. An electrically insulating film-like sleeve 71 extends between the outer surface of unit 66, where the voltage-carrying wires 13 lie unprotected, and jacket 68. This insulates the wires 13 from the inner surface of ferromagnetic jacket 68. Situated on the upper side is an insulating plate 72 which has through-holes for passage of the connecting wires to connecting pins 35 for the primary winding. Situated on the underside is a functionally corresponding insulating plate 73 with a passage for allowing through the connections of the secondary windings to connecting pins 36 for these secondary windings.

FIG. 22 shows a vertical section on enlarged scale of the connection between the end zones of a winding and the associated external connecting pins 35, which connecting pins 35 extend through a filler block 76 of electrically insulating material received in a recess in ferromagnetic cover 70.

Ferromagnetic cover 70 with filler block 76 and coupling surfaces 75 on the underside of connecting pins 35 takes place via the electrically insulating plate 72, which can for instance be embodied as film. Attention is drawn to the fact that, with a view to good positioning and a reliable electrically conductive connection between pins 35 and end zones 74, the coupling surfaces are provided with shallow grooves lying in the direction of the roughly radially extending upper parts of wires 13.

FIG. 23 shows a round, flat, membrane-like plastic carrier 78 with a substantially circular, loop-shaped copper track 3 and a ferromagnetic zone 77 present in the central zone thereof, in which zone ferromagnetic powder material is incorporated in finely distributed manner in the plastic substrate of the flat carrier for the purpose of forming a continuous ferromagnetic core inside the space, enclosed by the turns or electrically conductive tracks 3 of a winding, of a stack of electrical elements 79 of the type according to FIG. 23.

FIG. 24 shows a stack of electrical elements as according to FIG. 2 prior to the curing of the plastic at the stage where by means of a schematically designated laser 80 a number of longitudinal through-holes 81 are arranged in the as yet not cured plastic substrate material for the purpose of enhancing rapid evaporation of solvent from the starting plastic material. It will be apparent that this variant is only worthwhile in the case where a solvent has been added to the substrate material.

The invention claimed is:

1. An electrical device, in particular a coil or a transformer, comprising a stack of electrical elements, wherein:

in the stack a central axis is defined which extends perpendicularly of the electrical elements;

each element comprises an electrically insulating flat carrier;

the carrier carries at least one electrically conductive loop-shaped track;

both end zones of the or each track are located in the edge zone of the carrier;

the loop-shaped tracks each form a turn and are arranged around the central axis in the stack;

the end zones are connected to each other in electrically conductive manner such that the turns form one winding in at least groupwise manner and that the electric currents conducted through the turns during operation of the device generate summating magnetic fields in the zone enclosed by the turns;

the carriers are congruent and each have a form such that they can be rotated from a starting position through an angle a around the central axis to a rotated position in which they take up the same space as in the starting position;

adjacent elements with tracks which together form a winding are disposed rotated through an angle a relative to each other such that only one end zone of the track of the one element is in register position relative to only one end zone of the track of the adjacent element, and these mutually registered end zones are mutually connected by an electrical conductor extending transversely of the elements;

the free end zones of the tracks of the outermost elements of the stack of elements, or at least that part of the stack with tracks which together form one winding, form the externally accessible terminals of the or each winding;

the elements are connected non-releasably to each other, and the stack has a peripheral surface with a form which is prismatic at least in its central zone, i.e. has the same cross-sectional form at any axial position.

2. The device as claimed in claim 1, wherein each track is located some distance from the peripheral edge of the carrier;

the end zones of the track are located close to the peripheral edge of the carrier in the edge zone thereof; and situated on the outer side of the stack and extending over the full height thereof are electrical conductors which each connect two mutually registered end zones of the tracks of adjacent elements electrically to each other.

3. The device as claimed in claim 1, wherein a ferromagnetic core is located in a space of the stack enclosed by the turns.

4. The device as claimed in claim 3, wherein a ferromagnetic zone is present in the space enclosed by the tum of each electrical element; each flat carrier comprises a plastic substrate; and the ferromagnetic zone comprises a magnetic material in powder form which is mixed through the substrate material and is thus embedded therein in substantially homogenous distribution.

5. The device as claimed in claim 3, wherein the end zones of the core are coupled at least magnetically to each other by a ferromagnetic yoke extending outside the stack such that the core and the yoke together form a closed magnetic circuit.

6. The device as claimed in claim 5, wherein the yoke comprises two yoke parts extending on either side of the stack.

7. The device as claimed in claim 5, wherein the yoke comprises two ferromagnetic plates at least magnetically coupled to the end zones of the core and a ferromagnetic jacket at least magnetically coupled to these plates; and situated in the jacket and/or in at least one of the plates is a passage for allowing through electrical conductors connected to both terminals of the or each winding.

8. The device as claimed in claim 5, wherein the ferromagnetic yoke comprises a plastic substrate into which magnetic material in powder form is mixed and is thus embedded therein in substantially homogenous distribution; and the yoke is manufactured by injection moulding.

9. The device as claimed in claim 1, wherein respective electrically conductive pins are connected to both terminals of the or each winding, which pins extend outside the peripheral surface of the device.

10. The device as claimed in claim 9, wherein the pins are located in a zone forming part of a flat part of the peripheral surface of the device extending in longitudinal direction, and the pins extend perpendicularly of this flat part.

11. The device as claimed in claim 9, configured to serve as transformer, wherein the tracks of the elements of the stack together form at least two windings, wherein a primary winding is configured to receive a relatively high alternating voltage and the or each other secondary winding is configured to generate a relatively low alternating voltage; and the pins connected to the primary windings are located on the one axial side of the device, and the pins connected to the or each secondary winding are located on the other axial side of the device.

12. The device as claimed in claim 11, wherein the pins are located in a zone forming part of a flat part of the peripheral surface of the device extending in axial direction, and the pins extend perpendicularly of this flat part.

13. The device as claimed in claim 11, wherein the tracks of the or each secondary winding have a larger cross-section than the tracks of the primary winding.

14. The device as claimed in claim 11, wherein a frequency converter is added to the device embodied as transformer which converts the frequency of the alternating current to be supplied to the primary winding from a relatively low value, for instance 50 or 60 Hz, to a relatively high value of a minimum of 100 kHz.

15. The device as claimed in claim 1, wherein thermally conductive protrusions are situated on the outer side of the device, which at least partially relinquish heat generated in the device to the surrounding area.

16. The device as claimed in claim 15, wherein the protrusions consist together or in groups of a plastic substrate through which thermally conductive material in powder form, is mixed and thus embedded therein in substantially homogenous distribution; and the protrusions are manufactured together or in groups by injection moulding or extension.

17. The device as claimed in claim 15 wherein each flatcarrier consists of a film material, wherein the film material is PI (polyimide) or PEI (polyetherimide).

18. A method for manufacturing an electrical device, in particular a coil or a transformer, comprising a stack of electrical elements, wherein:

in the stack a central axis is defined which extends perpendicularly of the electrical elements;

each element comprises an electrically insulating flat carrier;

the carrier carries at least one electrically conductive loop-shaped track;

both end zones of the or each track are located in the edge zone of the carrier;

the loop-shaped tracks each form a turn and are arranged around the central axis in the stack;

the end zones are connected to each other in electrically conductive manner such that the turns form one winding in at least groupwise manner and that the electric currents conducted through the turns during operation of the device generate summating magnetic fields in the zone enclosed by the turns;

the carriers are congruent and each have a form such that they can be rotated from a starting position through an angle a around the central axis to a rotated position in which they take up the same space as in the starting position;

adjacent elements with tracks which together form a winding are disposed rotated through an angle a relative to each other;

adjacent elements are disposed rotated through an angle relative to each other such that only one end zone of the track of the one element is in register position relative to only one end zone of the track of the adjacent element, and these mutually registered end zones are mutually connected by an electrical conductor extending transversely of the elements;

the free end zones of the tracks of the outermost elements of the stack of elements, or at least that part of the stack with tracks which together form one winding, form the externally accessible terminals of the or each winding;

the elements are connected non-releasably to each other, and the stack has a peripheral surface with an at least roughly prismatic form, i.e. has the same cross-sectional form at any axial position;

which method comprises the following steps, to be performed in suitable sequence, of:

(a) providing the electrical elements, each comprising:

a carrier which can withstand a temperature T4, and the at least one loop-shaped track, the material of which track has a melting temperature T1 and which carrier can withstand a temperature T4;

(b) providing the end zones with a layer of soldering material, such as a for instance eutectic mixture of lead and tin, which soldering material has a melting temperature T2;

(c) stacking the elements onto each other such that adjacent elements are rotated through the angle a such that the or each track of each element has only one end zone which is registered with only one end zone of a track of the or each adjacent element;

(d) arranging a longitudinal recess in the outer surface of the prismatic stack at each angular position of the stack at the position of an end zone of a track of an element;

(e) providing electrically conductive wires, the material of which has a melting temperature T3;

(f) providing the wires with a layer of soldering material;

(g) positioning the wires in the recesses;

(h) heating the stack to a temperature TS, wherein:

T5>T2

T5 <T4

T5 <T1

T5<T3;

(i) fusing and curing the carriers in step (h) by evaporating solvent out of and/or changing the structure of the material of the carriers such that the stack becomes monolithic;

(j) soldering the wires to the associated end zones of the tracks in step (h) by melting the soldering material; and (k) cooling the thus formed device.

19. An electronic unit, comprising a carrier with at least one electronic circuit, from which carrier protrude a number of terminals which are connected internally to the or each circuit characterised in that the carrier carries at least one transformer, which transformer converts a supply voltage to a down-transformed voltage, and the carrier also carries rectifier means which convert the down-transformed voltage to at least one direct voltage necessary for the functioning of the or each circuit.

20. The electronic unit as claimed in claim 19, wherein at least one elongate transformer is located in an area of the edge zones of the carrier.

* * * * *